US008336326B2

(12) United States Patent
Sasaki et al.

(10) Patent No.: US 8,336,326 B2
(45) Date of Patent: Dec. 25, 2012

(54) DISPENSER

(75) Inventors: Makoto Sasaki, Aichi (JP); Motohiro Kawachi, Aichi (JP); Kouichi Itou, Aichi (JP); Hiroshi Nagai, Aichi (JP)

(73) Assignee: Hoshizaki Denki Kabushiki Kaisha, Aichi-ken (JP)

( * ) Notice: Subject to any disclaimer, the term of this patent is extended or adjusted under 35 U.S.C. 154(b) by 528 days.

(21) Appl. No.: 12/629,290

(22) Filed: Dec. 2, 2009

(65) Prior Publication Data

US 2010/0140292 A1 Jun. 10, 2010

(30) Foreign Application Priority Data

Dec. 4, 2008 (JP) ..... 2008-310277

(51) Int. Cl.
*F25C 1/22* (2006.01)

(52) U.S. Cl. ..... 62/340

(58) Field of Classification Search ..... 62/354, 62/340; 220/52, 64, 108, 192
See application file for complete search history.

(56) References Cited

U.S. PATENT DOCUMENTS 3,892,335 A * 7/1975 Schroeder ..... 222/129.1
4,644,757 A 2/1987 Hida et al.
5,440,892 A 8/1995 Tatematsu et al.
6,182,453 B1 * 2/2001 Forsberg ..... 62/125
2004/0231354 A1 11/2004 Tsuchikawa et al.

FOREIGN PATENT DOCUMENTS

JP 63-63887 4/1988

OTHER PUBLICATIONS

European Search Report (in English language) issued Jan. 21, 2011 in corresponding European Patent Application No. 09 01 5005.

* cited by examiner

*Primary Examiner* — Melvin Jones
(74) *Attorney, Agent, or Firm* — Wenderoth, Lind & Ponack, LLP

(57) ABSTRACT

Provided is a dispenser including an ice-making water tank for storing ice-making water and an auger-type ice-making machine for producing ice chips by freezing the ice-making water in the ice-making water tank. The auger-type ice-making machine includes a refrigeration casing into which the ice-making water is supplied, and the refrigeration casing and the drain pan are connected to each other through the intermediation of an ice-making water drain pipe. The ice-making water in the refrigeration casing is drained at predetermined time points, and the drain pan is washed with the ice-making water thus drained.

2 Claims, 3 Drawing Sheets

DISPENSER

BACKGROUND OF THE INVENTION

1. Field of the Invention

The present invention relates to a dispenser for producing ice chips from ice-making water, in particular, a dispenser comprising a drain pan for receiving at least one of the ice chips and a beverage.

2. Description of the Related Art

In general, as such conventionally-used dispensers, an ice chip dispenser and a beverage dispenser are provided. The ice chip dispenser delivers ice chips in response to an operation performed by a user. The beverage dispenser delivers not only ice chips but also water and beverages such as juice and soup in response to an operation performed by a user. In many cases, such dispensers are installed in family restaurants and the like so as to be freely operated by users as a so-called "drink bar area" and to allow the users to freely pour beverages that they want by themselves. Meanwhile, leftover juice and the like of the users are disposed of into a drain pan of the dispenser in many cases. Thus, in order to prevent the juice and the like disposed into the drain pan from drying and adhering thereto, it is necessary to wash the drain pan.

For example, Japanese Utility Model Application Laid-open No. Sho 63-63887 discloses an apparatus comprising an ice-making water tank for storing ice-making water from which ice chips are produced, and in which the ice-making water therein is supplied into a drain pan so as to wash same. In this apparatus, a sheet-type ice-making machine for freezing the ice-making water and the ice-making water tank are connected to each other through the intermediation of a water supply pipe, and the water supply pipe and the drain pan are connected to each other through the intermediation of a drain pipe. The sheet-type ice-making machine includes an ice-making plate for freezing the ice-making water supplied from the ice-making water tank so that the ice-making water is frozen on a front side of the ice-making plate. When the ice-making water is frozen, a deicing cycle is started in which the ice-making water is sprayed onto a back side thereof so as to remove ice on the front side, and the ice thus removed is delivered as ice chips. Further, when the deicing cycle is started, an electromagnetic valve for opening and closing the drain pipe is opened, and the drain pan is washed with the ice-making water supplied through the intermediation of the drain pipe.

However, in the apparatus disclosed in Japanese Utility Model Application Laid-open No. Sho 63-63887, the wash water is supplied to the drain pan only when the deicing cycle is started, which means that the timing of washing the drain pan becomes irregular. Specifically, depending on the installation environment of the dispenser, the deicing cycle may not be performed all day long. Thus, there has been a problem in that it is impossible to reliably prevent the juice and the like from adhering to the drain pan. Further, it is necessary to provide a drain pipe for washing the drain pan, and necessary to control the electromagnetic valve for opening and closing the drain pipe, which leads to a problem of the apparatus configuration and apparatus control become more complicated.

SUMMARY OF THE INVENTION

The present invention has been made to solve the above-mentioned problems. It is therefore an object of the present invention to provide a dispenser which periodically supplies wash water into the drain pan without a complicated configuration and without the need for complicated control so as to easily and reliably prevent juice and the like from adhering to the drain pan.

In order to achieve the above-mentioned object, a dispenser according to an aspect of the present invention comprises: an ice-making section for producing ice chips by freezing ice-making water; an ice-making water drain passage for draining the ice-making water supplied to the ice-making section; and a drain pan for receiving at least one of the ice chips and a beverage. The ice-making section includes a refrigeration casing for freezing the ice-making water therein, and the ice-making water drain passage connects the refrigeration casing and the drain pan to each other.

Further, a dispenser according to another aspect of the present invention includes: an ice-making section for producing ice chips by freezing ice-making water; an ice-making water drain passage for draining the ice-making water supplied to the ice-making section; and a drain pan for receiving at least one of the ice chips and a beverage, the dispenser further including the following: an ice-making water supply passage for supplying the ice-making water to the ice-making section; a water supply valve for opening and closing the ice-making water supply passage; and a control section for controlling the water supply valve to open and close the ice-making water supply passage. The ice-making section includes the following: an ice-making water tank connected to the ice-making water supply passage, for storing the ice-making water therein; and an overflow pipe for draining, when the amount of ice-making water in the ice-making water tank exceeds a predetermined amount, surplus of the ice-making water in the ice-making water tank. The ice-making water drain passage connects the overflow pipe and the drain pan to each other, and the control section controls the water supply valve to open and close the ice-making water supply passage so that the surplus ice-making water is caused to overflow and is drained from the ice-making water tank at predetermined time points.

Further, the dispenser further includes a water level sensor for detecting a water level of the ice-making water in the ice-making water tank, and the control section controls the water supply valve to open the ice-making water supply passage for a predetermined time period from a time point when the water level sensor detects that the amount of the ice-making water in the ice-making water tank has exceeded the predetermined amount.

DESCRIPTION OF THE PREFERRED EMBODIMENTS

In the following, description is made on embodiments of the present invention with reference to accompanying drawings.

First Embodiment

Figure 1:
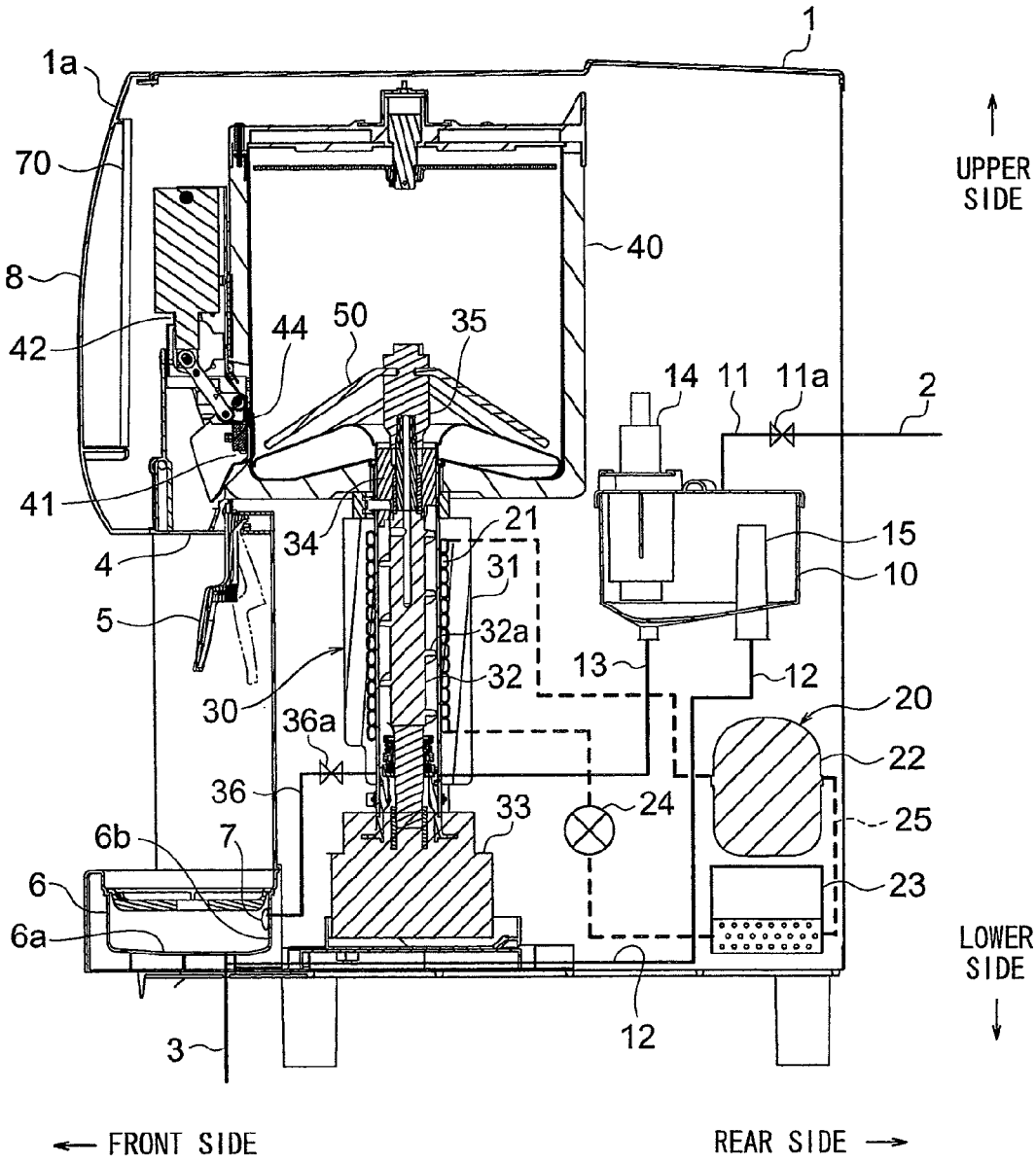
FIG. 1 is a sectional side view of a dispenser according to a first embodiment of the present invention.

FIG. 1 illustrates a dispenser according to a first embodiment of the present invention. The dispenser includes a housing 1, and an ice-making water tank 10 for storing ice-making water from which ice chips are formed is accommodated in the housing 1. One end of an ice-making water supply passage 11 is connected to a top portion of the ice-making water tank 10, and the other end of the ice-making water supply passage 11 is connected to an external tap-water system 2. A water supply valve 11*a* is provided in the ice-making water supply passage 11. When the water supply valve 11*a* is opened so as to open the ice-making water supply passage 11, tap water is supplied as ice-making water from an external tap water system 2 into the ice-making water tank 10. The water supply valve 11*a* closes the ice-making water supply passage 11 when not being energized and opens the ice-making water supply passage 11 when being energized.

Further, in the housing 1, there is accommodated an auger-type ice-making machine 30 for producing ice chips from the ice-making water in the ice-making water tank 10. The auger-type ice-making machine 30 includes a refrigeration casing 31 having a substantially cylindrical shape and extending in an upper and lower direction indicated by arrows in FIG. 1. One end of a water supply pipe 13 is connected to a bottom portion of the refrigeration casing 31. The other end of the water supply pipe 13 is connected to a bottom portion of the ice-making water tank 10 so that the ice-making water in the ice-making water tank 10 is supplied through the water supply pipe 13 into the refrigeration casing 31.

Around an outer peripheral portion of the refrigeration casing 31, there is wound a cooling pipe 21. The cooling pipe 21 constitutes an evaporator of a refrigeration circuit 20 in which the cooling pipe 21, a compressor 22, a condenser 23, and an expansion valve are sequentially connected to each other through the intermediation of a refrigerant pipe 25 and refrigerant circulates therethrough. That is, evaporation of the refrigerant communicating in the cooling pipe 21 causes the ice-making water in the refrigeration casing 31 to be cooled and frozen, and ice from which ice chips are formed is formed on an inner surface of the refrigeration casing 31. Herein, the ice-making water tank 10, the auger-type ice-making machine 30, and the refrigeration circuit 20 constitute an ice-making section of the dispenser of the present invention.

In the refrigeration casing 31, there is rotationally provided an auger 32 having a helical blade 32*a*. The auger 32 is coupled with a geared motor 33 provided below the refrigeration casing 31. When the auger 32 is driven and rotated by the geared motor 33, the helical blade 32*a* rotationally moves along an inner peripheral surface of the refrigeration casing 31. The ice formed on the inner surface of the refrigeration casing 31 is scraped off by the rotationally moving helical blade 32*a*, and then conveyed to an upper side of the refrigeration casing 31.

In an upper side with respect to the refrigeration casing 31, there are provided a press head 34 for compressing the ice conveyed by the helical blade 32*a* and a cutter 35 for breaking the ice compressed by the press head 34 into an appropriate size so as to produce ice chips. Around the press head 34 and the cutter 35, there is provided a hollow ice-storage chamber 40, and the ice chips produced by the cutter 35 are stored in the ice-storage chamber 40. An upper end portion of the auger 32 passes through the press head 34 so as to be coupled with the cutter 35, and hence the auger 32 and the cutter 35 can be rotated integrally with each other. Further, to an outer peripheral portion of the cutter 35, there is integrally fixed an agitator 50 for agitating the ice chips in the ice storage chamber 40.

On a side surface of the ice-storage chamber 40, there are provided an opening 41 formed in a portion on a front side and a lower side indicated by arrows in FIG. 1, and a shutter 44 for opening and closing the opening 41. An actuator 42 for actuating the shutter 44 is provided to a portion on an upper side of the opening 41, and a delivery port 4 communicated with the opening 41 and opened to the lower side is formed on a lower side with respect thereto. Further, a lever 5 to be manipulated by a user of the dispenser is attached to the delivery port 4. When the lever 5 is rotated to a position indicated by a double-dashed line in FIG. 1, the actuator 42 actuates the shutter 44 so as to open the opening 41.

Further, on a lower side with respect to the delivery port 4, there is provided a drain pan 6 for receiving fallen ice chips which have failed to be received by the user, for example. The drain pan 6 is a box-shaped member opened on an upper side thereof, and at a bottom portion 6*a* thereof, there is formed a drain port 9 (refer to FIG. 2) for communicating the inside and outside of the drain pan 6. An external drain system 3 is connected to the drain port 9 so that water generated by molten ice chips in the drain pan 6 can be drained to the external drain system 3 through the drain port 9.

In addition, on a front portion of the housing 1, a front panel 1*a* is attached to a portion corresponding to a periphery of the ice-storage chamber 40. The front panel 1*a* is opened and closed so that the inside of the housing 1 can be exposed. On the back side of the front panel 1*a*, there is provided a control section 70 for controlling the operation of the dispenser. On the front side of the front panel 1*a*, there is provided an operation unit 8 including switches to be operated by the user, for inputting predetermined signals to the control section 70. Based on the signals input from the operation unit 8, pre-stored programs, and the like, the control section 70 controls the operation of the water supply valve 11*a*, the geared motor 33, the actuator 42, and the like.

In the dispenser structured as described above, to a bottom portion of the refrigeration casing 31, there is connected one end of an ice-making water discharge pipe 36 for draining the ice-making water in the refrigeration casing 31 to the outside. The other end of the ice-making water discharge pipe 36 extends from the inside of the housing 1 to the outside so as to be connected to a wash water port 7 serving as a hole formed in a side surface on the rear side of the drain pan 6. Further, the ice-making water discharge pipe 36 is provided with a drain valve 36*a* for opening and closing the ice-making water discharge pipe 36 in response to a valve-opening instruction output from the control section 70. That is, when the drain valve 36*a* opens so as to open the ice-making water discharge pipe 36, the ice-making water in the refrigeration casing 31 is supplied as wash water into the drain pan 6, the ice-making water discharge pipe 36 constituting an ice-making water drain passage.

Herein, the ice-making water in the refrigeration casing 31 contains components such as calcium and magnesium. The ice-making water is gradually frozen from a portion having a high degree of purity as water, and hence those components remain in the refrigeration casing 31 in a state of being condensed in the ice-making water as ice-making time progresses. The residual components adhering to inner surfaces of the refrigeration casing 31 cause failures of the refrigeration casing 31, abnormal noise, and the like. When the dispenser according to this embodiment is installed in a "drink bar area" in family restaurants and the like, beverages such as juice may be disposed into the drain pan 6 of the dispenser. When the juice and the like disposed of into the drain pan 6 dry and adhere thereto, it is difficult to wash the drain pan 6.

In the control section 70, predetermined time periods are pre-stored within which the components remaining in the ice-making water are prevented from adhering in the refrigeration casing 31 and juice and the like disposed into the drain pan 6 are prevented from drying and adhering thereto. The control section 70 is configured to output the valve-opening instruction to the drain valve 36*a* so that the ice-making water in the refrigeration casing 31 is drained into the drain pan 6 through the ice-making water discharge pipe 36 at predetermined time points.

Figure 2:
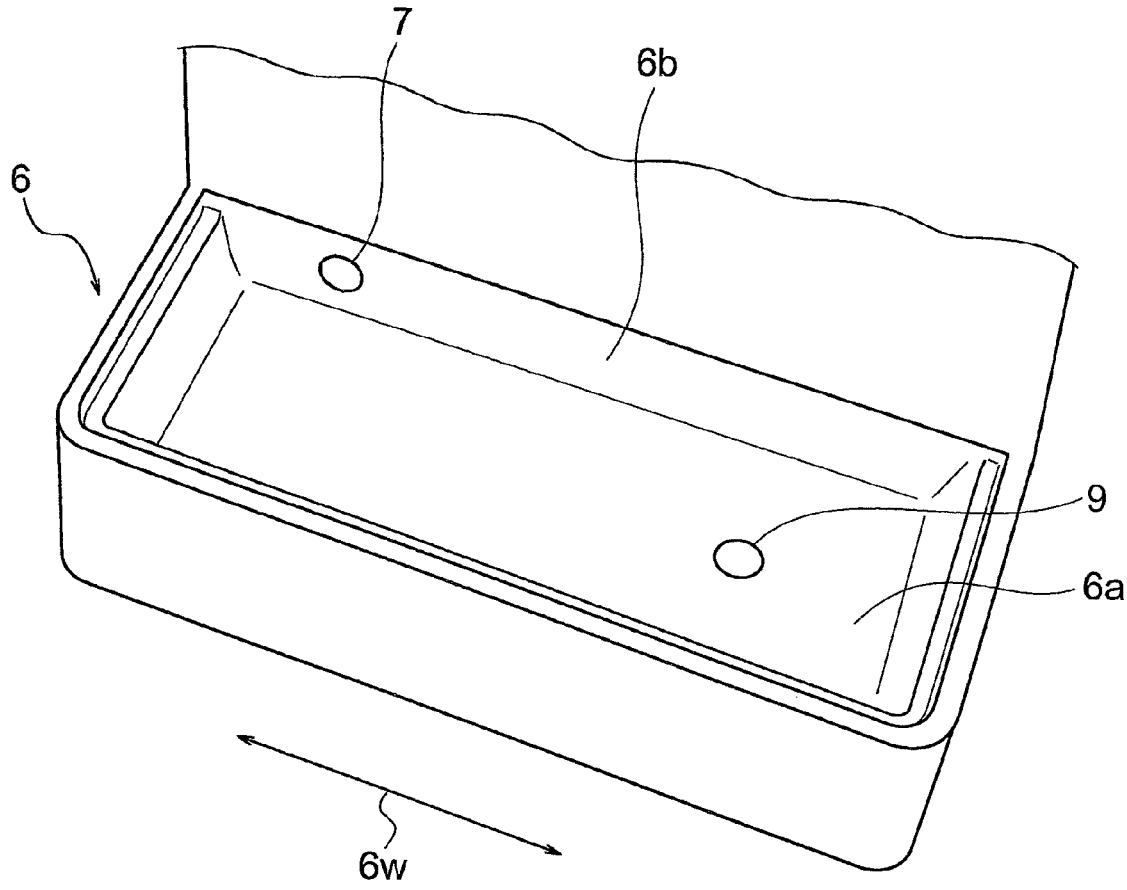
FIG. 2 is a perspective view of a drain pan of the dispenser of FIG. 1.

As illustrated in FIG. 2, the wash water port 7 and the drain port 9 of the drain pan 6 are arranged on opposite sides to each other with respect to a width direction of the drain pan 6 as indicated by the arrow 6*w* in FIG. 2. Thus, the ice-making water supplied into the drain pan 6 through the wash water port 7 does not directly flow into the drain port 9, and hence it is possible to wash a wider area of the bottom portion 6*a* with the ice-making water.

Referring back to FIG. 1, the ice-making water tank 10 includes a float sensor 14 serving as a water level sensor for detecting the water level of the ice-making water therein. The float sensor 14 includes a float (not shown) floating in the ice-making water and moving in accordance with the water level. Further, the float sensor 14 includes a float switch (not shown) for detecting that the water level of the ice-making water in the ice-making water tank 10 has reached an upper-limit water level or a lower-limit water level. The float switch outputs signals to the control section 70, the signals indicating that the position of the float has reached the upper-limit water level or the lower-limit water level, respectively.

Further, the ice-making water tank 10 includes an overflow pipe 15 for draining, when an amount of the ice-making water supplied into the ice-making water tank 10 exceeds a predetermined amount, that is, the upper-limit water level owing to failures and the like in the water supply valve 11*a* and the float sensor 14, surplus of the ice-making water therein corresponding to the amount exceeding the upper-limit water level to the outside. The overflow pipe 15 is a member having a cylindrical shape, and an upper end portion thereof is arranged on an upper side with respect to the upper-limit water level in the ice-making water tank 10. Meanwhile, a lower end portion of the overflow pipe 15 passes through a bottom portion of the ice-making water tank 10 so as to extend to the outside, and is connected to the external drain system 3 through the intermediation of an overflow drain pipe 12.

Next, description is made on the operation of the dispenser according to a first embodiment of the present invention with reference to FIGS. 1 and 2.

When the operation of the dispenser is started, the control section 70 controls whether or not the water supply valve 11*a* is energized in response to detection results of the float sensor 14 regarding the water level so as to maintain the water level in the ice-making water tank 10 within a predetermined range. Further, the ice-making water in the ice-making water tank 10 is supplied into the refrigeration casing 31 through the water supply pipe 13, and hence the water level of the ice-making water in the refrigeration casing 31 is also maintained within a predetermined range.

When the ice-making water is supplied into the refrigeration casing 31, the control section 70 starts operation of the auger-type ice-making machine 30 and the refrigeration circuit 20. The refrigerant circulating through the refrigeration circuit 20 cools the refrigeration casing 31 when being evaporated in the cooling pipe 21, and ice is formed on the inner surface of the refrigeration casing 31. The helical blade 32*a* of the auger 32 driven and rotated by the geared motor 33 scrapes off the ice formed on the inner surface of the refrigeration casing 31, and conveys the ice thus scraped-off to the upper side.

The ice conveyed to the upper side by the helical blade 32*a* of the auger 32 is compressed at the time of passing through the press head 34 and is formed into a bar-like shape. The cutter 35 breaks the obtained bar ice pieces into an appropriate size so as to produce ice chips, and the ice chips thus produced are stored in the ice-storage chamber 40. When the opening 41 is opened by the shutter 44 in accordance with the lever 5 manipulated by the user, the ice chips stored in the ice-storage chamber 40 are delivered from the delivery port 4 to the lower side, and provided to the user.

In the dispenser operating as described above, after a predetermined time period has elapsed from the start of the operation, the control section 70 outputs the valve-opening instruction to the drain valve 36*a*. The drain valve 36*a* receiving the valve-opening instruction is opened so as to open the ice-making water discharge pipe 36 and drain the ice-making water in the refrigeration casing 31. The ice-making water drained from the refrigeration casing 31 is discharged from the wash water port 7 through the ice-making water discharge pipe 36 into the drain pan 6. The wash water port 7 and the drain port 9 (refer to FIG. 2) are arranged on opposite sides to each other, and hence the discharged ice-making water flows over a wider range of the bottom portion 6*a* of the drain pan 6 so as to wash the drain pan 6. Subsequently, the control section 70 repeats draining of the ice-making water from the refrigeration casing 31 at predetermined time points.

As described above, in the dispenser according to the first embodiment of the present invention, the refrigeration casing 31 and the drain pan 6 are connected to each other through the intermediation of the ice-making water discharge pipe 36. Thus, the drain pan 6 can be washed with secondary use of the ice-making water periodically drained from the refrigeration casing 31. That is, it is unnecessary to provide additional piping or electromagnetic valves for supplying the wash water into the drain pan 6, and it is possible to freely change the frequency of washing the drain pan 6 by merely changing the timing of draining the ice-making water from the refrigeration casing 31. Thus, in the dispenser, it is possible to periodically supply the wash water into the drain pan 6 without more complicated configuration and without the need for more complicated control, and hence possible to easily and reliably prevent juice and the like from adhering to the drain pan 6.

Second Embodiment

Figure 3:
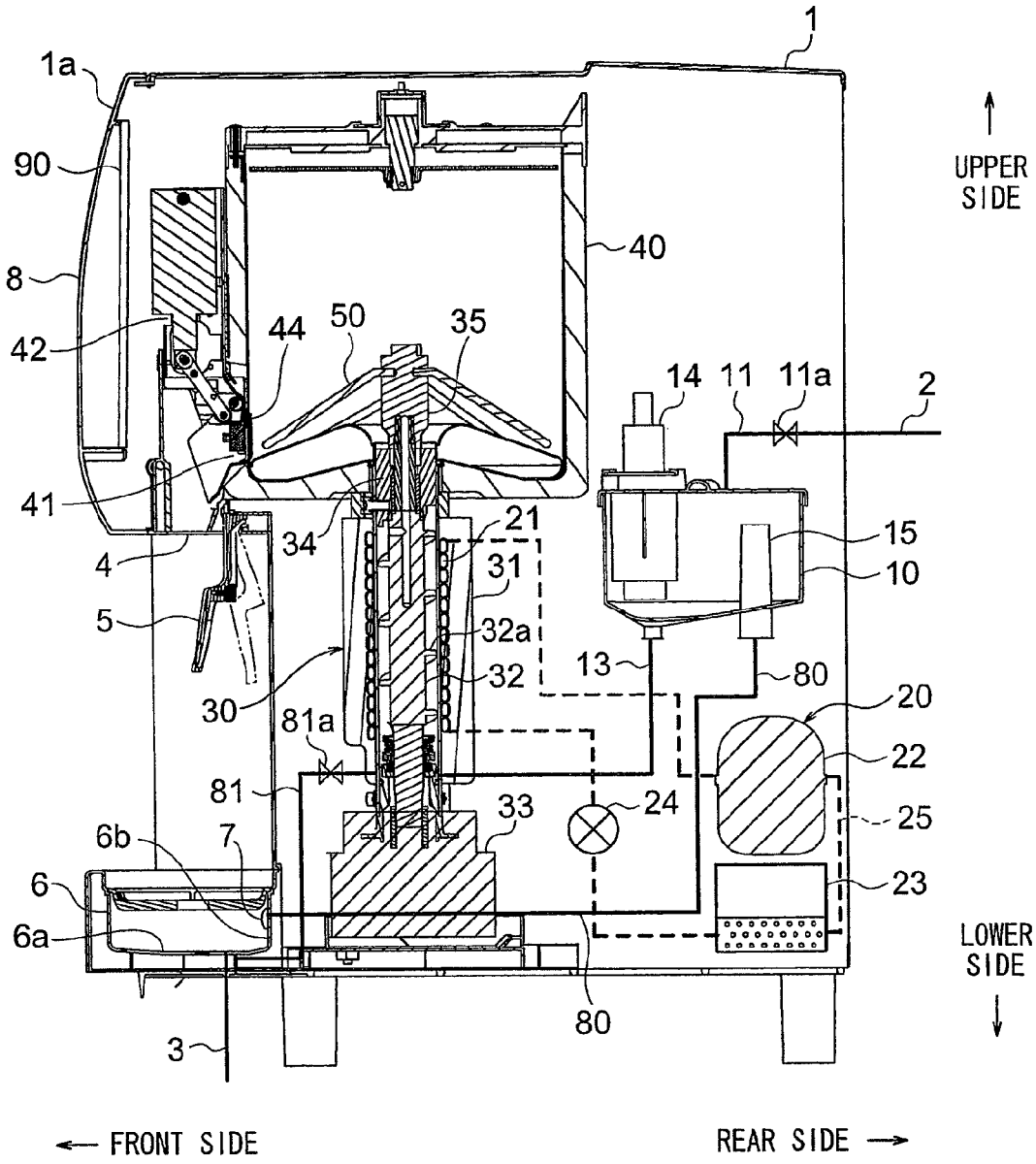
FIG. 3 is a sectional side view of a dispenser according to a second embodiment of the present invention.

Next, description is made on a configuration of a dispenser according to a second embodiment of the present invention with reference to FIG. 3. The dispenser according to the second embodiment is configured to utilize the ice-making water in the ice-making water tank 10 whereas the drain pan 6 is washed by utilizing the ice-making water in the refrigeration casing 31 in the dispenser according to the first embodiment. Note that, in the following description of the second embodiment, the same or similar components as those in FIGS. 1 and 2 are described while denoted by the same reference symbols, and detailed description thereof is omitted.

As illustrated in FIG. 3, one end of a drain pipe 80 is connected to the lower end portion of the overflow pipe 15 provided in the ice-making water tank 10, and the other end of the drain pipe 80 is connected to the wash water port 7 of the drain pan 6. That is, in the dispenser according to the second embodiment, the drain pipe 80 constitutes an ice-making water drain passage. Thus, when ice-making water corresponding to an amount exceeding the upper-limit water level is supplied into the ice-making water tank 10 and the surplus of the ice-making water is drained, that is, when a so-called overflow occurs, the ice-making water that overflowes is supplied to the drain pan 6. Further, the refrigeration casing 31 is directly connected to the external drain system 3 through the intermediation of an ice-making water discharge pipe 81.

A control section 90 is set to energize the water supply valve 11*a* provided in the ice-making water supply passage 11 at predetermined time points until the float sensor 14 outputs a signal indicating that the ice-making water has reached the upper-limit water level. Further, upon reception of the signal indicating that the water level in the ice-making water tank 10 has reached the upper-limit water level from the float sensor 14, the control section 90 is set to continue energization of the water supply valve 11*a* for a predetermined time period after that time point. That is, the control section 90 is configured to deliberately cause a predetermined amount of the ice-making water to overflow from the ice-making water tank 10 at predetermined time points. The remaining configuration is the same as that of the first embodiment.

Next, description is made of operation at the time of washing the drain pan 6 in the dispenser according to the second embodiment. Note that, the operations of producing ice chips and delivering the ice chips are the same as that of the first embodiment.

After a predetermined time period has elapsed from the start of the operation of the dispenser, the control section 90 performs control such that the water supply valve 11*a* is energized irrespective of the detection results of the water level by the float sensor 14, and the water level in the ice-making water tank 10 is increased. When the water level in the ice-making water tank 10 is increased and reaches the upper-limit water level, the float sensor 14 outputs a signal to the control section 90, the signal indicating that the water level has reached the upper-limit water level. Upon reception of the signal indicating that the water level has reached the upper-limit water level, the control section 90 performs control for a preset time period such that the energization of the water supply valve 11*a* is continued for a preset time period.

As a result of the continuation of the energization of the water supply valve 11*a* for a predetermined time period after the water level in the ice-making water tank 10 has reached the upper-limit water level, a predetermined amount of ice-making water is made to overflow from the ice-making water tank 10. The ice-making water having overflowed from the ice-making water tank 10 is supplied into the drain pan 6 through the overflow pipe 15, the drain pipe 80, and the wash water port 7 of the drain pan 6 in the stated order. The ice-making water supplied into the drain pan 6 washes the inside of the drain pan 6 and is drained to the external drain system 3 through the drain port 9. Subsequently, the control section 90 repeatedly causes overflows from the ice-making water tank 10 at predetermined time points.

As described above, in the dispenser according to the second embodiment of the present invention, the overflow pipe 15 of the ice-making water tank 10 and the drain pan 6 are connected to each other. The control section 90 controls the water supply valve 11*a* for opening and closing the ice-making water supply passage 11 so as to cause overflows at predetermined time points. Thus, the drain pan 6 is washed with the ice-making water having overflowed. That is, the overflow pipe 15, which is conventionally directly connected to the external drain system 3, is connected to the drain pan 6, and hence it is unnecessary to provide additional piping or electromagnetic valves for supplying the ice-making water into the drain pan 6. Further, the ice-making water is made to overflow by merely controlling the water supply valve 11*a* for opening and closing the ice-making water supply passage 11. Thus, it is possible to easily control the timing of causing overflows without complicated control of the dispenser. Thus, in the dispenser, it is possible to periodically supply the wash water into the drain pan 6 without a complicated configuration and without the need for complicated control, and hence possible to easily and reliably prevent juice and the like from adhering to the drain pan.

Further, the dispenser includes the float sensor 14 for detecting the water level of the ice-making water in the ice-making water tank 10, and the control section 90 controls the water supply valve 11*a* to open the ice-making water supply passage 11 for a predetermined time period from a time point when the float sensor 14 detects that the amount of the ice-making water in the ice-making water tank 10 has exceeded the predetermined amount. That is, at the time of the overflows repeated at predetermined time points, it is possible to maintain a set amount of the ice-making water to be supplied into the drain pan 6. Further, by changing the time period during which the water supply valve 11*a* is energized, it is possible to freely set the time period during which the water supply valve 11*a* is opened, and hence it is possible to easily have the desired amount of ice-making water overflow.

The invention claimed is:

1. A dispenser comprising:

an ice-making section for producing ice chips by freezing ice-making water;

an ice-making water drain passage for draining the ice-making water supplied to the ice-making section; and a drain pan for receiving at least one of the ice chips and a beverage, the dispenser further comprising:

an ice-making water supply passage for supplying the ice-making water to the ice-making section;

a water supply valve for opening and closing the ice-making water supply passage; and a control section for controlling the water supply valve to open and close the ice-making water supply passage, wherein:

the ice-making section comprises:

an ice-making water tank connected to the ice-making water supply passage, for storing the ice-making water therein; and an overflow pipe for draining, when an amount of the ice-making water in the ice-making water tank exceeds a predetermined amount, surplus of the ice-making water in the ice-making water tank; and the ice-making water drain passage connects the overflow pipe and the drain pan to each other; and the control section controls the water supply valve to open and close the ice-making water supply passage so that the surplus of the ice-making water is made to overflow and is drained from the ice-making water tank at predetermined time points.

2. A dispenser according to claim 1, further comprising a water level sensor for detecting water level of the ice-making water in the ice-making water tank, wherein the control section controls the water supply valve to open the ice-making water supply passage for a predetermined time period from a time point when the water level sensor detects that the amount of the ice-making water in the ice-making water tank has exceeded the predetermined amount.

* * * * *